United States Patent [19]

Ratcliff

[11] Patent Number: 5,052,590

[45] Date of Patent: Oct. 1, 1991

[54] RESEALABLE DUAL COMPARTMENT CONTAINER

[76] Inventor: Perry A. Ratcliff, 7125 E. Lincoln Dr., Scottsdale, Ariz. 85253

[21] Appl. No.: 521,275

[22] Filed: May 9, 1990

Related U.S. Application Data

[60] Division of Ser. No. 300,752, Jan. 23, 1989, abandoned, which is a continuation of Ser. No. 855,893, Apr. 24, 1986, abandoned.

[51] Int. Cl.[5] ..... B65D 35/22

[52] U.S. Cl. ..... 222/94; 222/129; 222/562; 424/52; 424/53

[58] Field of Search ..... 222/94, 135, 136, 129, 222/548, 549, 562; 424/52, 53; 239/327, 353, 414

[56] References Cited

U.S. PATENT DOCUMENTS

| | | | |
|---|---|---|---|
| 1,894,115 | 1/1933 | Murphy | 222/94 |
| 3,271,242 | 9/1966 | McNicholas et al. | 424/53 |
| 3,335,912 | 8/1967 | Reeves | 222/94 |
| 3,506,157 | 4/1970 | Dukess | 222/94 |
| 3,788,520 | 1/1974 | Dukess | 222/94 |
| 3,918,612 | 11/1975 | Voulgaris | 222/144.5 |
| 4,528,180 | 7/1985 | Schaeffer | 424/52 |
| 4,592,488 | 6/1986 | Simon et al. | 222/94 |
| 4,592,489 | 6/1986 | Simon et al. | 222/94 |

FOREIGN PATENT DOCUMENTS

| | | | |
|---|---|---|---|
| 2341302 | 2/1976 | France | 424/53 |
| 60-105610-A | 11/1983 | Japan . | |

OTHER PUBLICATIONS

"Effect of Hydrogen Sulfide and Methyl Mercaptan on the Permeability of Oral Mucosa", W. Ng and J. Tonzetich.

"Histologic and Immunologic Evaluation of Antigen Penetration into Oral Tissues after Topical Application", Anthony A. Rizzo.

"Effects of Highly Concentrated Stannous Fluoride and Chlorhexidine Regimes on Human Dental Plaque Flora", Schaeken, DeJong, Franken and van der Hoeven.

"Today's Dentistry: A New Drill", *Time*, Sep. 9, 1985, p. 73.

*Primary Examiner*—Kevin P. Shaver

*Attorney, Agent, or Firm*—Cahill, Sutton & Thomas

[57] ABSTRACT

Effective but interreactive compounds which, if maintained segregated prior to point of use, can be used as a mouthwash or as a dentifrice to complement one another and serve as a caries control agent and as an antimicrobial agent to reduce formation of dental plaque and reduction of bacteria, dental decay, gingivitis and malodor.

8 Claims, 1 Drawing Sheet

RESEALABLE DUAL COMPARTMENT CONTAINER

This is a divisional application of application Ser. No. 300,752, filed on Jan. 23, 1989, now abandoned of Perry A. Ratcliff for "METHOD FOR FORMING A COMPOSITION" which is a continuation application of application Ser. No. 855,893, filed Apr. 24, 1986, now abandoned, entitled "MOUTHWASH AND DENTIFRICE".

Mouthwashes have been used for the purpose of improving the odor of the mouth as well as for the purpose of reducing dental plaque. The reduction of dental plaque is achieved by antimicrobial agents which reduce the numbers of organisms that produce this substance. Dental plaque is therefore considered to be the etilogic agent of both dental decay and gingivitis. Research done by applicant and described in Applicant's U.S. Pat. Nos. 4,689,215 and 4,696,811 shows that stabilized chlorine dioxide is an effective agent for the reduction of malodor (anti-bacterial effect against putative organisms causing malodor) and the subsequent reduction of plaque scores in humans. Similar studies have been done in relationship to sodium fluoride for its reduction of bacteria, dental decay and gingivitis, as evidenced in an article incorporated herein by reference and entitled "Changes in Oral Health From 1973 to 1982 of 13-15 Year Old Schoolchildren Residing in Three Different Fluoride Areas in Finland" J DENT RES, 64 (10): 1253-1256, October 1985.

The purpose of a dentifrice is to help remove plaque and stains from teeth. It also serves as a deodorizing agent to counteract or inhibit malodor. Within the last two decades, various additives have been included for purposes of inhibiting dental decay, enhancing visual appeal, enhancing taste and freshening the mouth. From a dental standpoint, the most significant additives have been, in the alternative, sodium fluoride or stannous fluoride. Twenty years ago, the dentifrice industry added sodium fluoride to toothpaste for a number of years. When it was determined that stannous fluoride was more effective than sodium fluoride, it replaced sodium fluoride as an additive. The expectation of better effectiveness was substantiated in a study reported in the 1985 issue of the Journal of Clinical Peridontology, Volume 12, pages 420 to 431 entitled "Effect of Self-Administered Daily Irrigation with 0.02% $SnF_2$ on Periodontal Disease Activity", and incorporated herein by reference, which indicated that stannous fluoride was considerably more efficacious as a caries control agent and as an antimicrobial agent than sodium fluoride. However, subsequently it was learned that the stannous fluoride was breaking down by the hydrolysis of the water in the toothpaste. Thus, by the time the consumer used such a dentifrice, the stannous fluoride was no longer an effective active ingredient. Consequently, sodium fluoride is the only additive presently used in dentifrices for the purpose of inhibiting dental decay.

Chlorhexidine gluconate is an effective ingredient as an antimicrobial agent which reduces the formation of dental plaque and inhibits subsequent formation of dental diseases. These properties are reviewed and analyzed in the following articles, incorporated herein by reference: "Effects of Highly Concentrated Stannous Fluoride and Chlorhexidine Regimes on Human Dental Plaque Flora" J DENT RES, 64 (1): 57-61, January, 1985, "Plaque Inhibition by Sustained Release of Chlorhexidine from Removable Appliances" J DENT RES, 64 (11): 1319-1321, November 1985, "The Antimicrobial and Clinical Effects of a Single Subgingivil Irrigation of Chlorhexidine in Advanced Periodontal Lesions" J CLN PERIODONTAL, 13: 74-80, 1986 and "Chlorhexidine: A Review of the Literature" The Journal of the Western Society of Periodontology, Vol. 31, No. 1, 1983. Although Chlorhexidine gluconate has not been available in the United States, it has been used throughout the balance of the world. It is anticipated that it will become available in the near future in a mouthwash to be distributed by the Procter & Gamble Company. Its antiplaque properties are much better than that of either sodium fluoride or stannous fluoride, Unfortunately, chlorhexidine gluconate is soluble in a water base. It is therefore impossible to mix chlorhexidine gluconate with stannous fluoride, the most efficacious fluoride compound, because of their chemical incompatability.

The present invention is directed to a method for providing a daily or periodic use by members of the general public a mouthwash and a dentifrice having chemically interreactive compounds for reducing plaque and the formation of dental diseases. For use as a mouthwash, a stabilized chlorine dioxide solution is located in one compartment of a two compartment dispenser and a sodium fluoride solution is placed in the second compartment. Upon partial or complete evacuation of the compartments of the dispenser into a container, such as a cup, the two solutions become mixed and will remain effective active ingredients if used as a mouthwash soon thereafter. For use as a dentifrice, chlorhexidine gluconate is stored within one compartment of a two compartment dispenser and a stannous fluoride compound is placed within the other compartment. On dispensation of the two compounds from within the dispenser onto a toothbrush or the like, mixing occurs and both compounds will remain effective active ingredients if used as a dentifrice shortly thereafter.

It is therefore a primary object of the present invention to provide a method for simultaneously using in a mouthwash and in a dentifrice two chemically interreactive compounds and preserving the efficacious benefits of each compound.

Still another object of the present invention is to provide a method for simultaneously using the most effective but chemically interreactive antibacterial agent and anticaries agent in a mouthwash.

Another object of the present invention is to provide a method for simultaneously using the most effective but chemically interreactive antimicrobial agent and anticaries agent in a dentifrice.

Yet another object of the present invention is to provide a mouthwash dispenser dispensing a stabilized chlorine dioxide solution in combination with a sodium fluoride solution.

Yet another object of the present invention is to provide an extended shelf life dentifrice having chemically interreactive compounds of chlorhexidine gluconate and a fluoride based gel.

A further object of the present invention is to provide an extended shelf life mouthwash having chemically interreacitve compounds of sodium fluoride and stabilized chlorine dioxide.

A still further object of the present invention is to provide a method for developing at the point of use a mouthwash having a combination of a sodium fluoride solution and a stabilized chlorine dioxide solution.

A yet further object of the present invention is to provide an extended shelf life dentifrice having chemically interreactive compounds of chlorhexidine gluconate and a fluoride based gel.

A yet further object of the present invention is to provide a method for developing at the point of use a dentifrice having a combination of chlorhexidine gluconate compound and a fluoride based gel.

These and other objects of the present invention will become apparent to those skilled in the art as the description thereof proceeds.

The present invention will be described with greater specificity and clarity with reference to the following drawings in which.

For the reasons stated above and supported by the documentation referenced, stabilized chlorine dioxide is an effective antibacterial agent against putative organisms which result in malodor of the mouth. Such reduction of organisms also produces a subsequent reduction of dental plaque. A compound of stabilized chlorine dioxide of the type usable in conjunction with the present invention may be obtained from the Biocide Chemical Company of Norman, Oklahoma; a usable compound is also readily available from any of the service stores of the Sears & Roebuck Company. Sodium fluoride is an effective agent for reducing bacteria, dental decay and gingivitis. It is readily available over the counter in pharmacies as an anticaries agent; it is also available from Mallinckrodt, Inc. of Paris, Kentucky.

Stabilized chlorine dioxide and sodium fluoride are not stable when mixed and through the resulting chemical interreaction, the efficacy of the individual compounds becomes negated. To obtain essentially the full benefit of each compound, the two compounds can be mixed if such mixing is at the point of use. That is, if actual use occurs soon after mixing, most of the chemical interreaction between the two compounds is preempted and the user will benefit from the superior properties of each compound through a single application of both compounds.

Figure 1:
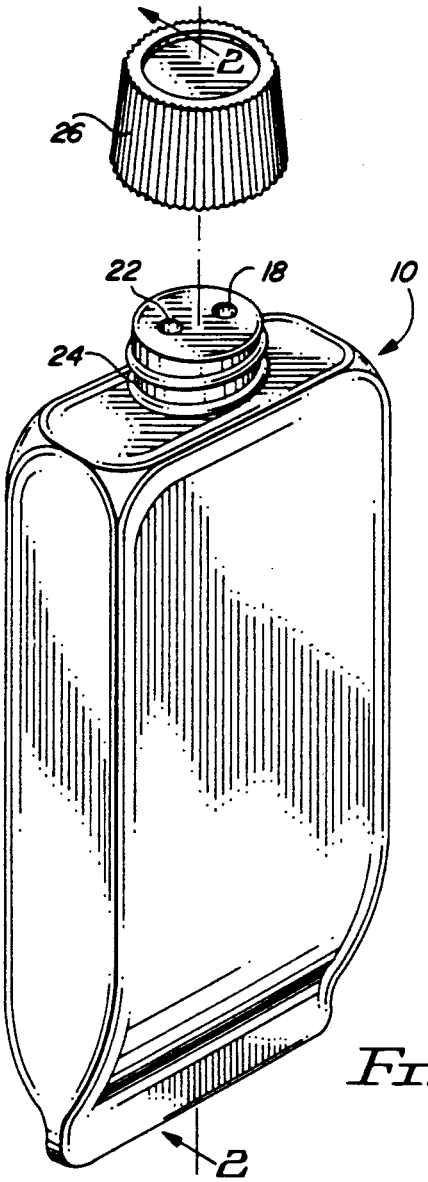
FIG. 1 is a perspective view of a dispenser.

Referring to FIG. 1, there is illustrated a dispenser 10 suitable for retaining and dispensing solutions of stabilized chlorine dioxide and sodium fluoride. The dispenser is ,a two compartment dispenser having compartment 12 segregated from compartment 14. Compartment 12 includes a passageway 16 having an outlet 18. Similarly, compartment 14 includes a passageway 20 having an outlet 22. Both passageways may be disposed in and extend through neck structure 24. A cap 26 may be employed to selectively close outlets 18 and 22.

Dispensing of solutions from within compartments 12 and 14 may be readily effected if dispenser 10 is of flexible material to permit manual squeezing of the dispenser. Such squeezing will create a pressure within each of compartments 12 and 14 and produce a concomittant discharge from outlets 18,22 via passageways 16, 20, respectively. It is to be noted that the solutions which may be contained within the two compartments are segregated from one another and will remain so segregated until subsequent to discharge through outlets 18,22. Thus, no chemical interreaction between the solutions within compartments 12, 14 will occur while the solutions are within dispenser 10.

For reasons stated above, dispenser 10 is particularly useful in storing, for an unlimited shelf life, a stabilized chlorine dioxide solution in compartment 12 and a sodium fluoride solution in compartment 14. In use, dispenser 10 is squeezed or otherwise manipulated to discharge the two solutions therefrom. Such discharge may be into a cup or other container wherefrom a user pours the liquid into his/her mouth to use a mouthwash. It is to be understood that the solutions contained in compartments 12 and 14 may be concentrated and require dilution after dispensation and prior to use. As such dilution is contemplated to be with regular tap water, some interreaction therewith may occur. However, the interreaction will not be damaging to the user; moreover, the extent and effect of such interreaction will be minimal if the mouthwash is used immediately or soon thereafter.

Accordingly, dispenser 10 provides a usable and convenient apparatus for making available to a user for simultaneous use the most effective compounds presently known for antibacterial and antidental decay agents in a single application.

The above referenced research has clearly indicated that chlorhexidine gluconate and stannous fluoride compounds have an efficacious use for humans. Ideally, administration of both compounds simultaneously would provide the most effective plaque control mechanism presently known. However, the chemical incompatability of these compounds has deterred and frustrated the dentifrice industry from providing a suitable and usable vehicle for such application.

Chlorhexidine gluconate, in a form suitable for use as a toothpaste, is manufactured by several companies, including Pierre Fabre, Inc. of France. Stannous fluoride is manufactured in the form of a gel by Scherer Laboratories, Inc. of Dallas, Texas; one form of such gel known to be usable in the present invention is sold under the trademark GEL-KAM.

Figure 2:
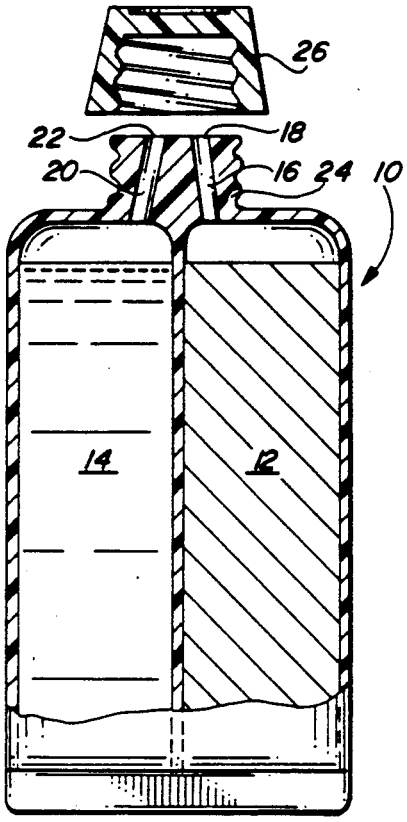
FIG. 2 illustrates a two container dispenser for dispensing a mouthwash taken along lines 2–2 as shown in FIG. 1.
Figure 3:
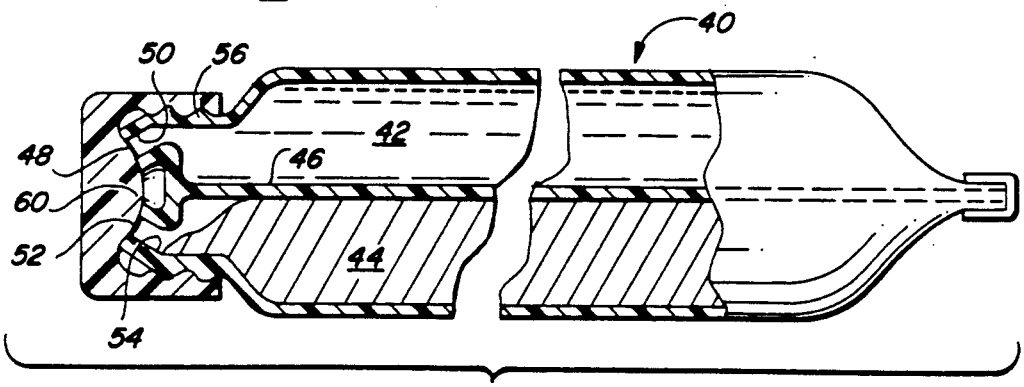
FIG. 3 is a partial cross sectional view of a two compartment dispenser for dispensing a dentifrice.

Referring to FIG. 2, there is shown a representation of a dual compartment toothpaste tube 40 usable in the present invention for the purpose of simultaneously dispensing a quantity of chlorhexidine gluconate compound and stannous fluoride gel. The tube includes a pair of compartments 42, 44 segregated from one another by a membrane 46. Outlet 48 is in fluid communciation with compartment 42 through passageway 50. Outlet 52 is in fluid communication with compartment 44 through passageway 54. Both passageways are developed within neck structure 56. A cap 58 may be used to threadedly engage the neck structure and seal outlets 48, 52. Through use of a seat 60 or similar device, cross flow between the outlets is precluded when cap 58 is in place.

In use, chlorhexidine gluconate,.in toothpaste form, may be deposited within compartment 42; stannous fluoride, in the form of a gel, may be deposited in compartment 44. By squeezing, compressing or otherwise manipulating tube 40, portions of the contents of compartments 42, 44 will be evacuated through outlets 48,42 onto a toothbrush or similar implement. Such evacuation will result in limited mixing of the two compounds but as use in the form of brushing one's teeth will occur essentially immediately, the beneficial effects of the chlorhexidine gluconate and stannous fluoride compounds will be realized.

The benefits achieved from using both compounds simultaneously and together include an increase in the protection that a user would have from using either product alone. Furthermore, there will be a significant reduction in the amount of plaque. The amount of microbial dental plaque, resultant decay and gingivitis will be reduced by a factor of approximately 26 percent over that of using only one of the compounds. It is to be understood that various additives may be incorporated for purposes of color, taste, texture and body. Accordingly, substantial benefits are achieved by using both compounds simultaneously over that of using either one alone, and such benefits are achieved without any further inconvenience, effort or time on the part of the user.

While the principles of the invention have now been made clear in an illustrative embodiment, there will be immediately obvious to those skilled in the art many modifications of structure, arrangement, proportions, elements, materials and components, used in the practice of the invention which are particularly adapted for specific environments and operating requirements without departing from those principles.

I claim:

1. Apparatus for dispensing in combined form separately housed incompatible compounds, said apparatus comprising in combination:

a) a first compartment for housing one of the compounds;

b) a second compartment for housing another of the compounds;

c) a first passageway extending from the first compartment for directing discharge of the one compound along a first axis;

d) a second passageway extending from the second compartment for directing discharge of the other compound along a second axis, which second axis intersects with the first axis downstream of said first and second passageways, the intersection of the first and second axis defining a point for combining the first and second compounds;

e) detachably attachable means for simultaneously sealing said first and second passageways to prevent flow therethrough;

f) said first passageway including an outlet defining a first plane;

g) said second passageway including an outlet defining a second plane, the second plane defining an angle with respect to the first plane which is less than 180°; and h) said sealing means including a first area oriented commensurate with aid first outlet to simultaneously contact the perimeter of said first outlet upon attachment of said sealing means and a second area oriented commensurate with the second outlet to simultaneously contact the perimeter of said second outlet upon attachment of said sealing means.

2. The apparatus as set forth in claim 1 wherein said first and second areas define portions of a curved surface of said sealing means.

3. The apparatus as set forth in claim 1 wherein one of the compounds is a stabilized chlorine dioxide solution and wherein the other of the compounds is a sodium fluoride solution.

4. The apparatus as set forth in claim 1 wherein one of the compounds is a stannous fluoride gel and wherein the other of the compounds is a stabilized chlorine dioxide solution.

5. The apparatus as set forth in claim 1 wherein one of the compounds is stannous fluoride compound and the other of the compounds is a chlorhexidine gluconate compound.

6. The apparatus as set forth in claim 1 wherein one of the compounds is a sodium fluoride compound and the other of the compounds is a chlorhexidine gluconate compound.

7. The apparatus as set forth in claim 1 wherein one of the compounds is a stabilized chlorine dioxide solution and wherein the other of the compounds is a fluoride solution.

8. The apparatus as set forth in claim 1 wherein one of the compounds is a fluoride compound and wherein the other of the compounds is a chlorhexidine gluconate compound.

* * * * *